US009216424B2

(12) United States Patent
Kennedy

(10) Patent No.: US 9,216,424 B2
(45) Date of Patent: Dec. 22, 2015

(54) SYSTEM AND METHOD OF SELECTIVE FLUID PATTERN DISTRIBUTION

(71) Applicant: AM Conservation Group, Inc., Charleston, SC (US)

(72) Inventor: Kevin Kennedy, Parsippany, NJ (US)

(73) Assignee: AM Conservation Group, Inc., Charleston, SC (US)

( * ) Notice: Subject to any disclaimer, the term of this patent is extended or adjusted under 35 U.S.C. 154(b) by 0 days.

(21) Appl. No.: 14/299,628

(22) Filed: Jun. 9, 2014

(65) Prior Publication Data

US 2014/0361098 A1 Dec. 11, 2014

Related U.S. Application Data

(60) Provisional application No. 61/833,684, filed on Jun. 11, 2013.

(51) Int. Cl.

| | |
|---|---|
| ***A62C 31/00*** | (2006.01) |
| ***B05B 17/04*** | (2006.01) |
| ***B05B 1/16*** | (2006.01) |

(52) U.S. Cl.

CPC ..... *B05B 1/1636* (2013.01)

(58) Field of Classification Search

CPC ..... B05B 1/18; B05B 1/185; B05B 1/169; B05B 1/1636; B05B 3/04; A61H 9/0028; E03C 1/23

USPC ..... 239/436, 443, 445, 438, 11

See application file for complete search history.

(56) References Cited

U.S. PATENT DOCUMENTS

| | | | | |
|---|---|---|---|---|
| 5,201,468 | A | 4/1993 | Freier et al. | |
| 5,979,800 | A | 11/1999 | Takagi | |
| 8,006,919 | B2 | 8/2011 | Renquist et al. | |
| 2005/0061896 | A1 * | 3/2005 | Luettgen et al. | 239/449 |
| 2007/0170284 | A1 * | 7/2007 | Nelson et al. | 239/443 |
| 2010/0301135 | A1 | 12/2010 | Hunnicutt et al. | |

OTHER PUBLICATIONS

PCT International Search Report from PCT/US2014/041711 dated Oct. 9, 2014.

PCT International Written Report from PCT/US2014/041711 dated Oct. 9, 2014.

* cited by examiner

*Primary Examiner* — Davis Hwu

(74) *Attorney, Agent, or Firm* — Brinks Gilson & Lione

(57) ABSTRACT

A fluid distributor has a component configured for selective rotation about a central axis of the fluid distributor, a fluid input, a first fluid output, and a second fluid output, wherein rotation of the component in a first direction about the central axis alternates selection between the first fluid output and the second fluid output and at least one of (1) the component is configured to rotate about the central axis by at least 360° in the first direction and such rotation of the component about the central axis provides at least four alternations between selection of the first fluid output and the second fluid output and (2) selection of the second fluid output is the next available fluid output for selection in response to rotating the component about the central axis away from a position of the component in which the first fluid output is selected.

19 Claims, 7 Drawing Sheets

SYSTEM AND METHOD OF SELECTIVE FLUID PATTERN DISTRIBUTION

RELATED APPLICATION

This application claims the benefit of U.S. Provisional Application No. 61/833,684, filed on Jun. 11, 2013, pending, the entirety of which is incorporated herein by reference.

BACKGROUND

Some fluid distributors, such as, but not limited to showerheads, faucet attachments, and/or water hose attachments are configured to allow selection between two or more fluid output patterns. In some cases, selection between two fluid output patterns requires pushing and/or pulling a portion of the fluid distributor generally along an output direction of the fluid distributor. In other cases, selection between a first fluid output pattern and a second fluid output pattern requires rotating a portion of the fluid distributor generally about an output direction of the fluid distributor in only one of two directions. For example, switching from a first fluid output pattern to a second fluid output pattern may require twisting a portion of the fluid distributor in a first direction as opposed to in a second direction opposite the first direction.

SUMMARY

In some embodiments, a fluid distributor is disclosed as comprising a component configured for selective rotation about a central axis of the fluid distributor, a fluid input, a first fluid output in selective fluid communication with the fluid input, and a second fluid output in selective fluid communication with the fluid input, wherein rotation of the component in a first direction about the central axis alternates selection between the first fluid output and the second fluid output and at least one of (1) the component is configured to rotate about the central axis by at least 360° in the first direction and such rotation of the component about the central axis by at least 360° provides at least four alternations between selection of the first fluid output and the second fluid output and (2) selection of the second fluid output is the next available fluid output for selection in response to rotating the component about the central axis away from a position of the component in which the first fluid output is selected.

In other embodiments, a method of selectively distributing a fluid is disclosed as comprising providing a fluid to a fluid input and providing a component that allows selection between a first fluid output and a second fluid output in response to rotation of the component about an axis, wherein when the component is in a position in which the first fluid output is selected (1) the next available fluid output selection in response to rotation of the component about the axis in a first direction is the second fluid output and (2) the next available fluid output selection in response to rotation of the component about the axis in a second direction is the second fluid output.

In yet other embodiments, a fluid distributor is disclosed as comprising a fluid flow divider plate comprising a plurality of first internal passages a plurality of second internal passages wherein the plurality of first internal passages and the plurality of second passages are alternatingly disposed next to each other about the central axis so that each of the first internal passages is substantially angularly bounded in both directions by second internal passages and so that each of the second internal passages is substantially angularly bounded in both directions by first internal passages. The fluid distributor further comprises a plurality of fluid flow selection seals disposed upstream relative to the fluid flow divider plate and a fluid distribution plate disposed between the plurality of fluid flow selection seals and the fluid flow divider plate, wherein the fluid distribution plate comprises a plurality of fluid distribution apertures configured for selective angular alignment with the plurality of fluid flow selection seals in response to rotation of the component about the central axis.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

This disclosure provides, in some embodiments, systems and methods for (1) selectively outputting a fluid flow in a first fluid output pattern as opposed to a second output pattern by rotating a portion of a fluid distributor in either of a first direction and a second direction that is opposite the first direction, (2) repeatedly alternating between a first fluid output pattern and a second fluid output pattern by repeatedly rotating a portion of a fluid distributor in a first direction, and (3) selectively outputting a fluid flow in a first fluid output pattern as opposed to a second output pattern in response to selectively directing fluid through a first interior opening of a switching plate as opposed to selectively directing fluid through a second interior opening of the switching plate that is angularly offset relative to the first interior opening about an axis of the switching plate.

Figure 1:
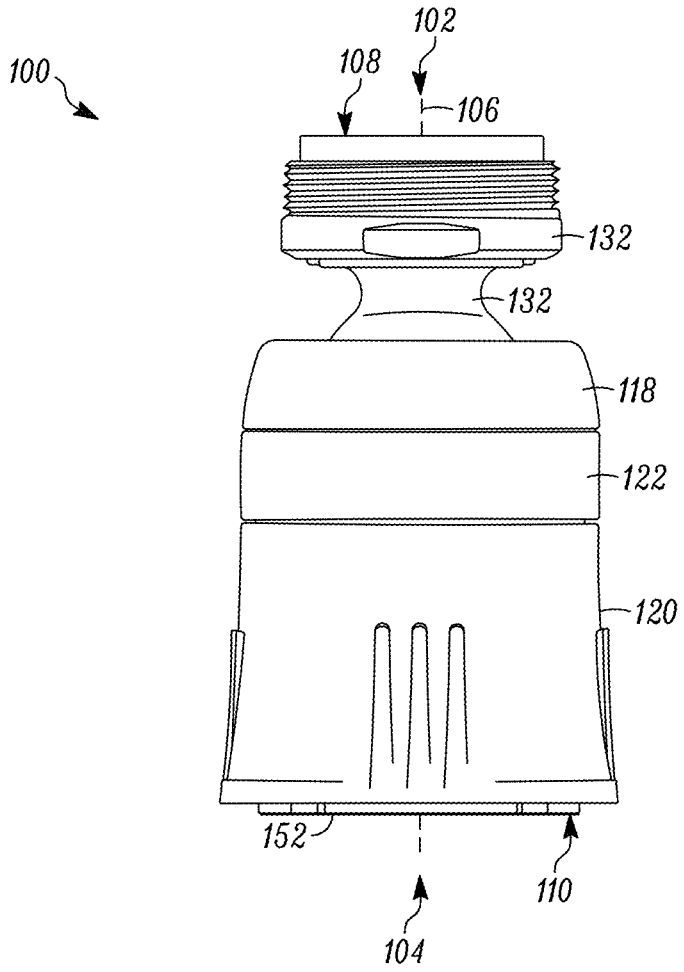
FIG. 1 is an orthogonal side view of a fluid distributor according to an embodiment of the disclosure.

Referring now to FIG. 1, an orthogonal side view of a fluid distributor 100 is shown according to an embodiment of the disclosure. The distributor 100 may be referred to as comprising a top 102, a bottom 104, and a central axis 106 that generally extends between the top 102 and the bottom 104. It will be appreciated that the top 102 and the bottom 104 are provided to serve as a basis for consistent reference to the distributor 100 and are not to be interpreted as a limitation of any application and/or manner of use of the distributor 100. The distributor 100 generally comprises a fluid input 108, a first fluid output 110, and a second fluid output 112. In this embodiment, the fluid input 108 may generally be configured to receive water from a water supply such as, but not limited to, a sink faucet, a shower faucet, a water hose, and/or any other suitable water supply. The first fluid output 110 may comprise an array of needle spray holes 114 configured in an angular array about the central axis 106 to generally selectively provide a plurality of separate and/or individual fluid flows and/or streams. The second fluid output 112 may comprise a generally centrally located hole, aperture, collection of apertures, and/or an opening 116 that may generally selectively provide an aerated, turbulent, and/or substantially singular flow of fluid. In alternative embodiments, a first fluid output and a second fluid output may be configured to provide any other suitable fluid flow type, such as, but not limited to, fluid flows comprising other turbulence, aeration, pressure, flow rate, pattern, array, and/or directionality characteristics. In this embodiment, the distributor 100 is configured to allow selective direction of fluid that enters the distributor 100 through the fluid input 108 to exit a selected one of the first fluid output 110 and the second fluid output 112 substantially to the exclusion of the other. In some embodiments, the fluid may be forced by physical seals that prevent fluid from continuously exiting both the first fluid output 110 and the second fluid output 112 while in other embodiments, fluid may be directed out a selected one of the first and second fluid outputs 110, 112 at least partially as a function of the fluid seeking a path of least resistance although paths to each of the first and second fluid outputs 110, 112 remain open. In other words, in some embodiments, fluid may be absolutely directed to one of the first and second fluid outputs 110, 112 is a function of purely structural flow paths while in other embodiments, fluid may be directed to one of the first and second fluid outputs 110, 112 at least partially as a function of a fluid dynamic flow characteristic of the fluid itself.

Figure 2:
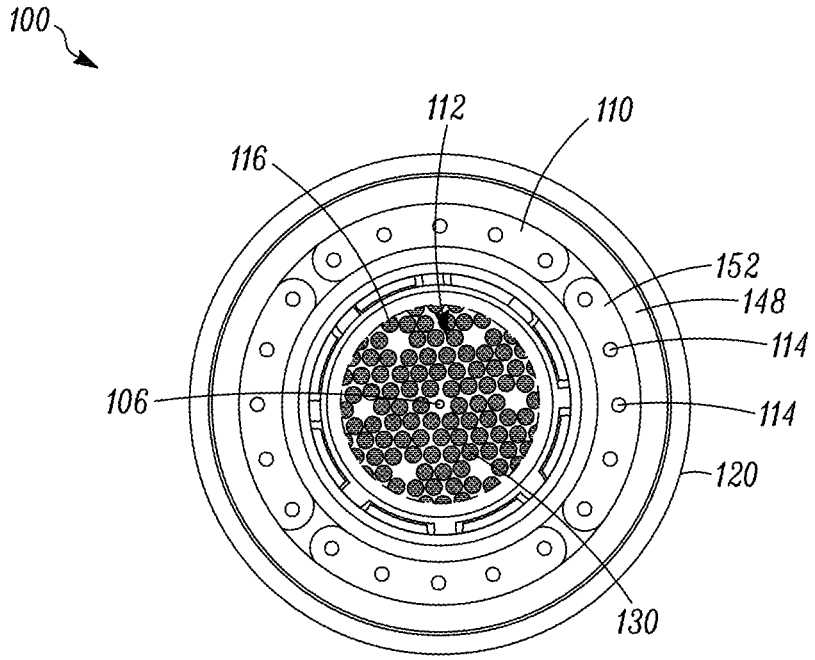
FIG. 2 is an orthogonal bottom view of the fluid distributor of FIG. 1.

Referring now to FIGS. 1 and 2, the distributor 100 generally comprises an outer shell comprising an input ring 118, an output ring 120, and an intermediate ring 122 generally disposed between the input ring 118 and the output ring 120. Most generally, the intermediate ring 122 may be angularly and longitudinally fixed relative to the input ring 118. However, the output ring 120 may be angularly rotated about the central axis 106 relative to at least one of the input ring 118 and intermediate ring 122. While components of the distributor 100 that are generally enveloped by the input ring 118, the output ring 120, and the intermediate ring 122 are discussed in greater detail below, an understanding of some embodiments of the disclosure may be generalized by noting that the above-described rotation of the output ring 120 relative to at least one of the input ring 118 and the intermediate ring 122 may contribute to selectively directing a fluid flow to exit the distributor 100 via the first fluid output 110 as opposed to the second fluid output 112 and/or selectively directing a fluid flow to exit the distributor 100 via the second fluid output 112 as opposed to the first fluid output 110. In some embodiments, the output ring 120 may be rotated relative to at least one of the input ring 118 and the intermediate ring 122 about the central axis 106 by at least about 360° thereby alternating selection between the first fluid output 110 and the second fluid output 112 at least one time as a result of the at least about 360° rotation. In some embodiments, the at least about 360° rotation may alternate selection between the first fluid output 110 and the second fluid output 112 more than once as a result of the at least about 360° rotation. In this embodiment, the above-described 360° rotation of the output ring 120 causes six alternations between fluid flow being directed out of the distributor 100 via the first fluid output 110 and the second fluid output 112. In alternative embodiments, a distributor substantially similar to distributor 100 may be configured to provide more or fewer than six alternations between fluid flow being directed out of the distributor 100 via the first fluid output 110 and the second fluid output 112.

Figure 3:
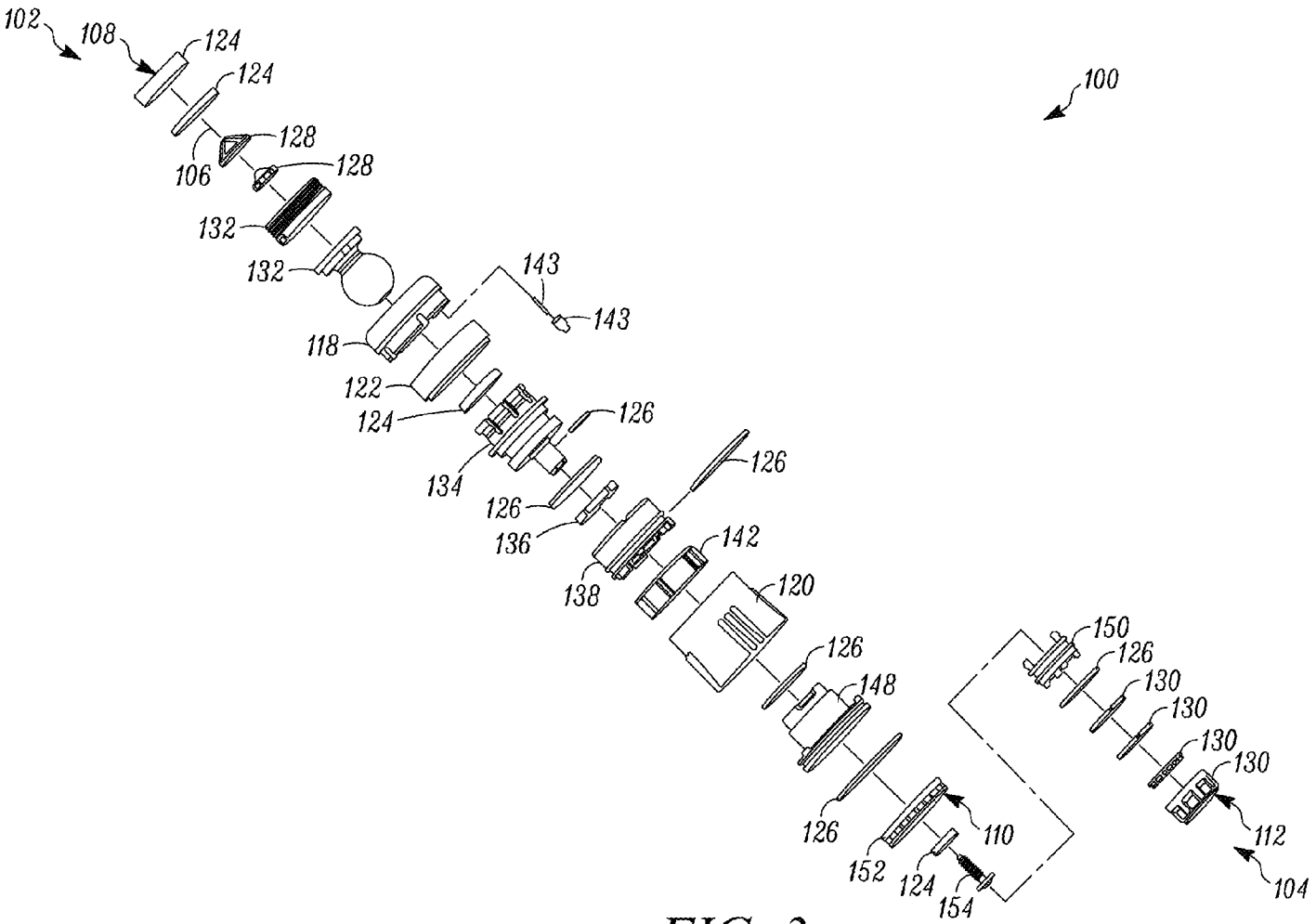
FIG. 3 is an orthogonal exploded side view of the fluid distributor of FIG. 1.

Referring now to FIG. 3, an orthogonal exploded side view of the distributor 100 is shown according to an embodiment of the disclosure. The distributor 100 further comprises a plurality of sealing devices, such as, but not limited to, a plurality of washers 124 and a plurality of circumferential seals 126. The distributor 100 further comprises flow compensator components 128, aerator components 130, and mounting components 132. The distributor 100 further comprises a body 134 configured to receive at least one fluid flow selection seal 136 into a downward facing concavity of the body 134. In some embodiments, the fluid flow selection seals 136 (which may be integrally formed as a ring or other integral shape) may interface with an upward facing surface of a fluid distribution plate 138 that comprises fluid distribution apertures 140 disposed in an angular and/or radial array about the axis 106. In some embodiments, the fluid flow selection seal 136 may be configured so that when properly angularly aligned with the fluid distribution plate 138, alternating and/or selected ones of the fluid distribution apertures 140 are sealed by the fluid flow selection seal 136. The fluid distribution plate 138 may further comprise detents 141 configured to interact with a biased component 143 that serves to indicate a correct angular positioning of the rotatable components of the distributor 100. The distributor 100 further comprises a fluid flow divider plate 142 that is generally located downstream relative to the fluid distribution plate 138. The fluid flow divider plate 142 may comprise a plurality of first internal passages 144 selectively in fluid communication with the fluid input 108 and the first fluid output 110 and a plurality of second internal passages 146 selectively in fluid communication with the fluid input 108 and the second fluid output 112. The plurality of first internal passages 144 and the plurality of second internal passages 146 are alternatingly disposed next to each other about the central axis 106 so that each of the first internal passages 144 is substantially angularly bounded in both directions by second internal passages 146 and so that each of the second internal passages 146 is substantially angularly bounded in both directions by first internal passages 144. In some embodiments, the first internal passages 144 may direct fluid flow relatively more radially outward from the central axis 106 as compared to fluid flow directed by the second internal passages 146. The distributor 100 may further comprise a faceplate 148 and a fluid delivery ring 150 that receives water from the fluid flow divider plate 142. The first fluid flow output 110 may be associated with a nozzle 152 that comprises the needle spray holes 114. A screw 154 may be used to retain the rotatable components to the body 134.

Figure 4:
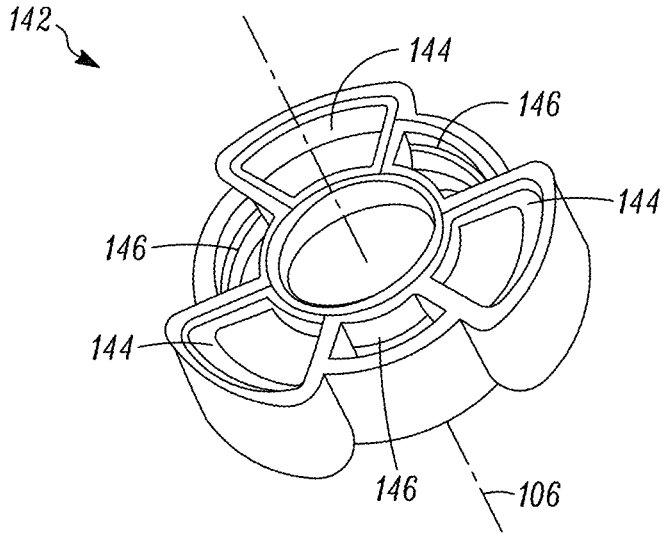
FIG. 4 is an oblique view of a fluid flow divider plate of the fluid distributor of FIG. 1.
Figure 5:
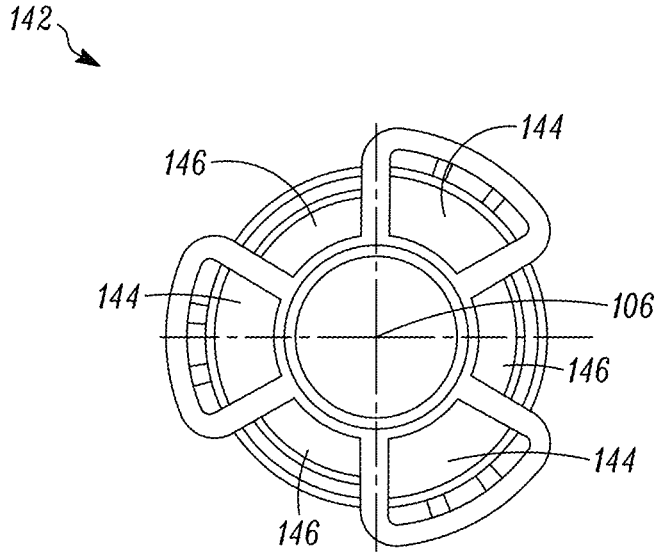
FIG. 5 is an orthogonal top view of the fluid flow divider plate of FIG. 4.

Referring now to FIGS. 4 and 5, oblique and orthogonal views of the fluid flow divider plate 142 are shown, respectively. The first internal passages 144 and second internal passages 146 may be configured to angularly segregate fluid paths associated with the first fluid output 110 and the second fluid output 112. While the fluid flow divider plate 142 and other associated components for angularly segregating fluid flow paths for the first fluid output 110 and the second fluid output 112 are shown as being divided into six angular sections about central axis 106, other numbers of angular divisions may be utilized in alternative embodiments.

Figure 6:
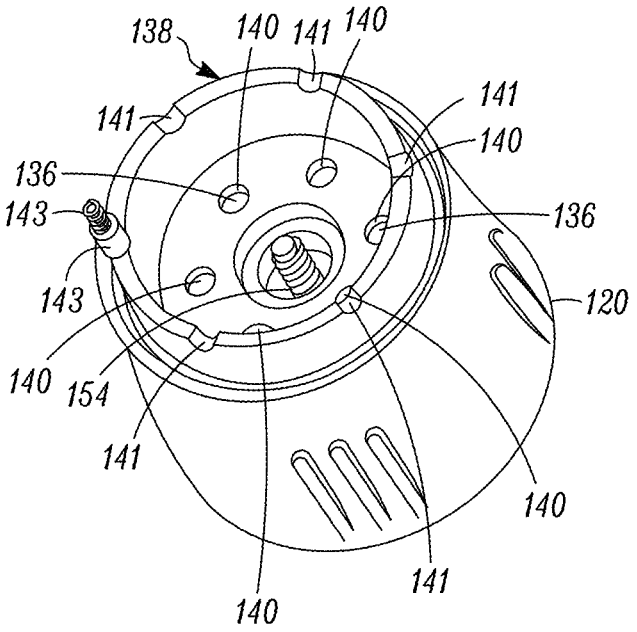
FIG. 6 is an oblique top view of a fluid distribution plate of the fluid distributor of FIG. 4.

Referring now to FIG. 6, an oblique view of the fluid distribution plate 138 is shown. While there are six fluid distribution apertures 140 disposed about central axis 106, other numbers of fluid distribution apertures 140 may be utilized in alternative embodiments. In some cases, the number of fluid distribution apertures 140 may equal the total number of first internal passages 144 and second internal passages 146.

Figure 7:
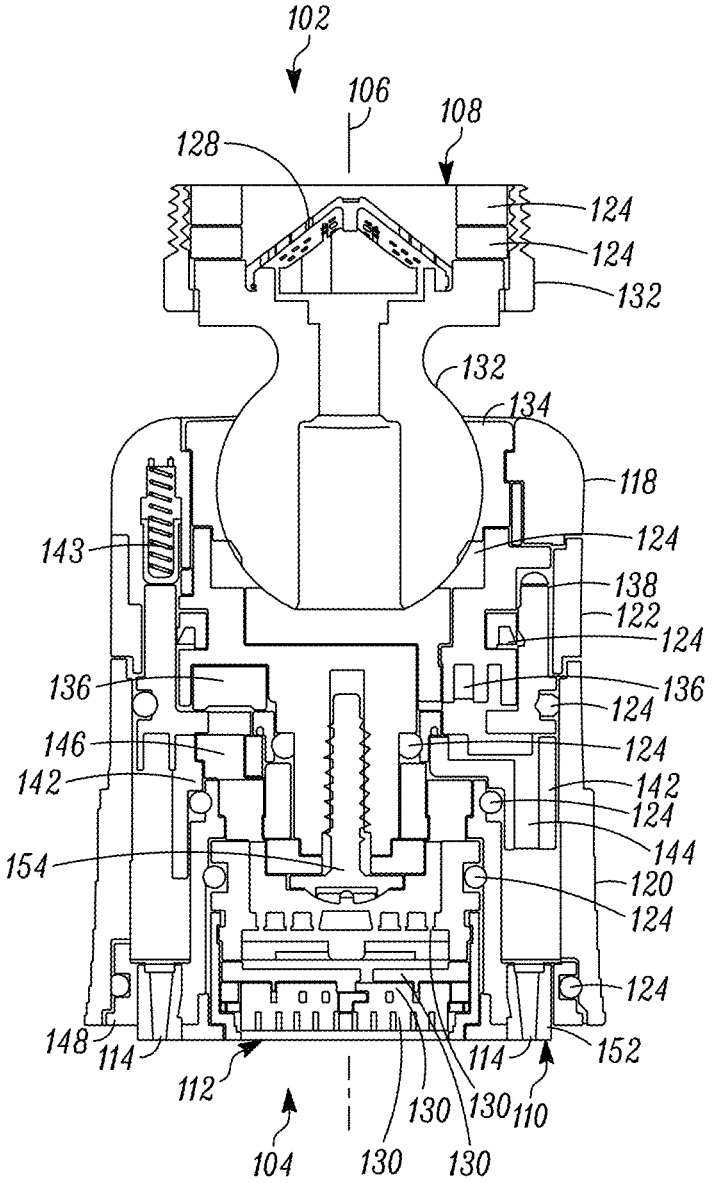
FIG. 7 is an orthogonal cross-sectional side view of the fluid distributor of FIG. 1 configured to flow fluid through a second fluid output.
Figure 8:
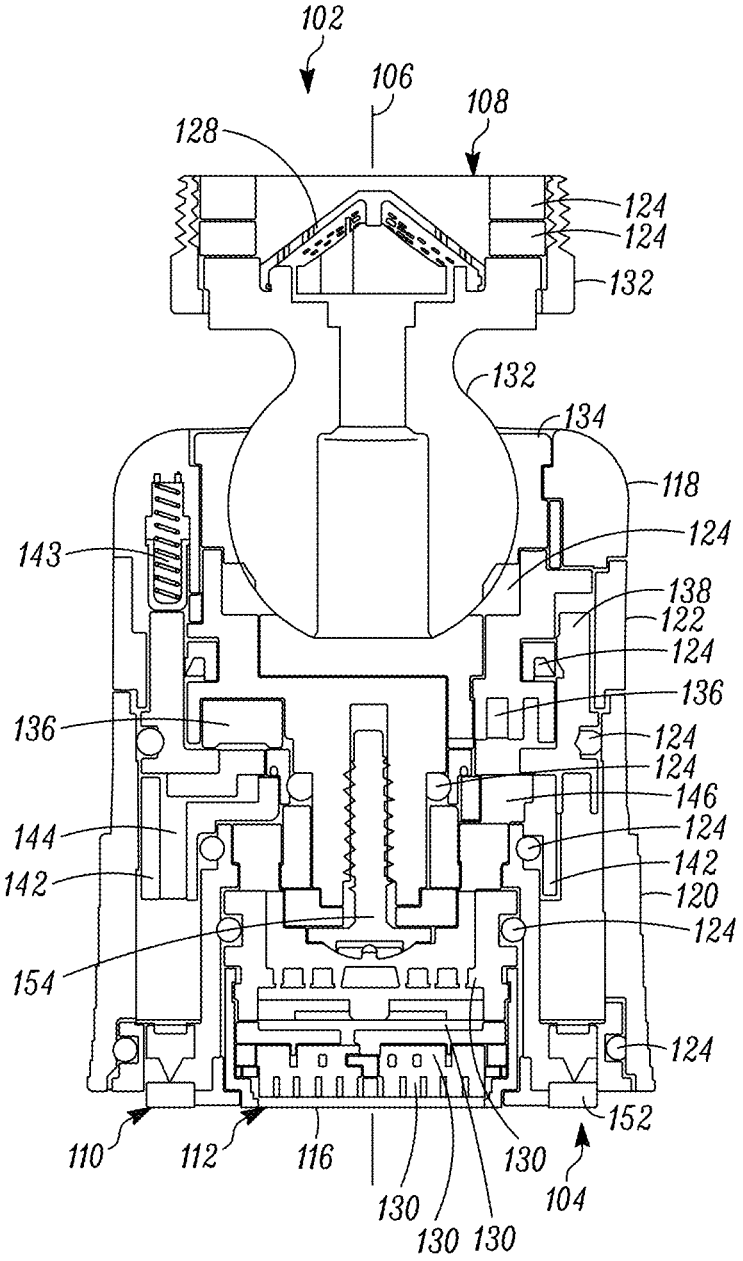
FIG. 8 is an orthogonal cross-sectional side view of the fluid distributor of FIG. 1 configured to flow fluid through a first fluid output.

Referring now to FIGS. 7 and 8, orthogonal cross-sectional side views of the distributor 100 are shown as configured for flowing fluid from the fluid input 108 to the first fluid output 110 and as configured for flowing fluid from the fluid input 108 to the second fluid output 112, respectively.

Most generally, in operation, the distributor 100 and substantially similar distributors may be used to select between a needle spray mode and a centralized aerated fluid output mode without pushing up or down on the distributor 100. Further, regardless of which mode the distributor 100 is initially operating, a user may simply turn twist the output ring 120 in either direction about the central axis 106 thereby causing the other available fluid output mode to be the next selected mode.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A fluid distributor, comprising:

a component configured for selective rotation about a central axis of the fluid distributor;

a fluid input;

a first fluid output in selective fluid communication with the fluid input; and a second fluid output in selective fluid communication with the fluid input; and, a fluid flow divider plate comprising:

a plurality of first internal passages selectively in fluid communication with the fluid input and the first fluid output;

a plurality of second internal passages selectively in fluid communication with the fluid input and the second fluid output;

wherein the plurality of first internal passages and the plurality of second passages are alternatingly disposed next to each other about the central axis so that each of the first internal passages is substantially angularly bounded in both directions by second internal passages and so that each of the second internal passages is substantially angularly bounded in both directions by first internal passages; and, wherein rotation of the component in a first direction about the central axis alternates selection between the first fluid output and the second fluid output and at least one of (1) the component is configured to rotate about the central axis by at least 360° in the first direction and such rotation of the component about the central axis by at least 360° provides at least four alternations between selection of the first fluid output and the second fluid output and (2) selection of the second fluid output is the next available fluid output for selection in response to rotating the component about the central axis away from a position of the component in which the first fluid output is selected.

2. The fluid distributor of claim 1, wherein the first fluid output is configured to provide a needle spray fluid flow pattern and wherein the second fluid output is configured to provide a substantially consolidated fluid flow pattern.

3. The fluid distributor of claim 1, wherein the component comprises a portion of an exterior shell of the fluid distributor.

4. The fluid distributor of claim 1, wherein the rotation of the component about the central axis moves the component longitudinally along the central axis.

5. The fluid distributor of claim 1, wherein the component is configured to resist longitudinal movement along the central axis in the absence of rotational movement of the component about the central axis.

6. The fluid distributor of claim 1, further comprising:

a plurality of fluid flow selection seals disposed upstream relative to the fluid flow divider plate; and a fluid distribution plate disposed between the plurality of fluid flow selection seals and the fluid flow divider plate, wherein the fluid distribution plate comprises a plurality of fluid distribution apertures configured for selective angular alignment with the plurality of fluid flow selection seals in response to rotation of the component about the central axis.

7. A method of selectively distributing a fluid, comprising:

providing a fluid to a fluid input; and providing a component that allows selection between a first fluid output and a second fluid output in response to rotation of the component about an axis; and, providing a fluid flow divider plate comprising:

a plurality of first internal passages selectively in fluid communication with the fluid input and the first fluid output;

a plurality of second internal passages selectively in fluid communication with the fluid input and the second fluid output;

wherein the plurality of first internal passages and the plurality of second passages are alternatingly disposed next to each other about the central axis so that each of the first internal passages is substantially angularly bounded in both directions by second internal passages and so that each of the second internal passages is substantially angularly bounded in both directions by first internal passages; and, wherein when the component is in a position in which the first fluid output is selected (1) the next available fluid output selection in response to rotation of the component about the axis in a first direction is the second fluid output and (2) the next available fluid output selection in response to rotation of the component about the axis in a second direction is the second fluid output.

8. The method of claim 7, further comprising:

wherein when the component is in a position in which the second fluid output is selected (1) the next available fluid output selection in response to rotation of the component about the axis in the first direction is the first fluid output and (2) the next available fluid output selection in response to rotation of the component about the axis in a second direction is the first fluid output.

9. The method of claim 7, wherein rotation of the component about the axis by 360° alternates selection between the first fluid output and the second fluid output at least four times.

10. The method of claim 7, wherein passing fluid through the first fluid output comprises distributing the fluid in a plurality of substantially distinct fluid streams.

11. The method of claim 7, wherein passing fluid through the first fluid output comprises distributing the fluid in a substantially consolidated fluid stream.

12. The method of claim 7, wherein selection between the first fluid output and the second fluid output requires rotation of the component about the axis and cannot be achieved only by longitudinal movement of the component along the axis.

13. The method of claim 7, wherein the component is constrained to require rotation of the component about the axis to longitudinally move the component along the axis.

14. A fluid distributor, comprising:

a fluid flow divider plate comprising:

a plurality of first internal passages;

a plurality of second internal passages;

wherein the plurality of first internal passages and the plurality of second passages are alternatingly disposed next to each other about the central axis so that each of the first internal passages is substantially angularly bounded in both directions by second internal passages and so that each of the second internal passages is substantially angularly bounded in both directions by first internal passages;

a plurality of fluid flow selection seals disposed upstream relative to the fluid flow divider plate; and a fluid distribution plate disposed between the plurality of fluid flow selection seals and the fluid flow divider plate, wherein the fluid distribution plate comprises a plurality of fluid distribution apertures configured for selective angular alignment with the plurality of fluid flow selection seals in response to rotation of the component about the central axis.

15. The fluid distributor of claim 14, wherein the first internal passages are in fluid communication with a first fluid output of the fluid distributor and wherein the second internal passages are in fluid communication with a second fluid output of the fluid distributor.

16. The fluid distributor of claim 15, wherein the first fluid output comprises a plurality of substantially distinct fluid output holes.

17. The fluid distributor of claim 16, wherein the second fluid output comprises a fluid output hole that is substantial coincident with the central axis.

18. The fluid distributor of claim 17, wherein the first fluid output and the second fluid output cannot be selected simultaneously.

19. The fluid distributor of claim 18, further comprising:

a flow compensator upstream relative to the fluid distribution plate; and an aerator downstream relative to the fluid flow divider plate.

* * * * *